US005244281A

United States Patent [19]

Wiliamson et al.

[11] Patent Number: 5,244,281

[45] Date of Patent: Sep. 14, 1993

[54] STATIC CONTROLLED COLLAPSIBLE RECEPTACLE

[75] Inventors: Robert R. Wiliamson, Dallas; Norwin C. Derby, Sherman, both of Tex.

[73] Assignee: Super Sack Manufacturing Co., Dallas, Tex.

[21] Appl. No.: 819,177

[22] Filed: Jan. 10, 1992

[51] Int. Cl.[5] ..... B65D 30/08; B65D 33/14

[52] U.S. Cl. ..... 383/24; 383/67; 383/109; 383/117

[58] Field of Search ..... 383/67, 109, 24, 117

[56] References Cited

U.S. PATENT DOCUMENTS

| | | | |
|---|---|---|---|
| 3,044,438 | 7/1962 | Osswald et al. . | |
| 3,445,055 | 5/1969 | Port . | |
| 3,555,170 | 1/1971 | Petzetakis . | |
| 3,596,134 | 7/1971 | Burke . | |
| 3,636,185 | 1/1972 | Ruddell et al. . | |
| 3,907,955 | 9/1975 | Viennot . | |
| 4,143,796 | 3/1979 | Williamson et al. . | |
| 4,149,755 | 4/1979 | Handleman et al. . | |
| 4,230,763 | 10/1980 | Skolnick . | |
| 4,457,456 | 7/1984 | Derby et al. | 141/114 |
| 4,467,005 | 8/1984 | Pusch et al. . | |
| 4,560,608 | 1/1985 | Pusch . | |
| 4,621,012 | 11/1986 | Pusch . | |
| 4,759,473 | 7/1988 | Derby et al. | 383/67 |
| 4,833,008 | 5/1989 | Derby . | |
| 5,024,792 | 6/1991 | Havens | 522/111 |
| 5,071,699 | 12/1991 | Pappas et al. | 383/117 |
| 5,092,683 | 3/1992 | Wurr . | |
| 5,100,943 | 3/1992 | Katoh et al. | 524/317 |

FOREIGN PATENT DOCUMENTS 8203202 9/1982 PCT Int'l Appl. .

*Primary Examiner*—Stephen P. Garbe
*Attorney, Agent, or Firm*—Michael A. O'Neil

[57] ABSTRACT

The present invention comprises a flexible, collapsible receptacle for handling flowable materials fabricated from an improved conductive woven metalized, anti-static fabric to more efficiently and effectively dissipate static electric build-up generated during the handling of flowable materials. In a first embodiment of the invention, a laminated metalized, anti-static fabric is utilized for fabricating all, or selected parts of the receptacle. In a second embodiment of the invention, all or part of the receptacle is formed from a sandwiched metalized and anti-static fabric. Parts of the receptacle not formed from either the laminated metalized, anti-static fabric or sandwiched metalized and anti-static fabric are fabricated from an anti-static fabric. Conductive anti-static lift straps are then added to the receptacle for support and to assist in static discharge. A conductive plastic liner is also inserted into the receptacle to further assist in the discharge of static build-up.

6 Claims, 9 Drawing Sheets 100
102
104
106
108
110
112
114
116
118
120
122
124

210
212
214
216
218
220
222
224
226
228
230
232
234

STATIC CONTROLLED COLLAPSIBLE RECEPTACLE

TECHNICAL FIELD

The present invention relates to the manufacture of collapsible receptacles for handling flowable materials, and in particular to the manufacture of collapsible receptacles fabricated from a metalized, static dissipating plastic fabric that assists in the prevention and control of static electric build-up.

BACKGROUND OF THE INVENTION

There has been an increasing interest of late in the use of flexible, collapsible containers for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

Fabrics are often utilized in the construction of flexible, collapsible containers where strength, flexibility and durability are important. Historically, such containers have been fabricated from natural fibers; however, in recent years synthetic fibers manufactured from polypropylene or other plastics have come into extensive use. The popularity of synthetic fibers can be attributed to the fact that they are generally stronger and more durable than their natural fiber counterpart.

Even with the advances in fabric construction from natural to synthetic fibers, fabrics in general possess qualities that render their use in certain applications undesirable. For example, the friction that occurs as flowable materials are handled by fabric receptacles tends to cause a significant build-up and retention of static electric charge within the receptacle. Discharge of the generated static electric build-up is often difficult, if not impossible, because fabrics are generally not electrically conductive materials. However, discharge is imperative as static charge potential poses a significant danger of fire or explosion resulting from a static generated electrical spark.

In an effort to address the undesirable static electric charge characteristic of fabrics, manufacturers of plastic fabrics covered one side of the fabric with a metallic foil-like layer to form a laminate. An adhesive is applied between the laminated layers to affix the foil-like layer to the plastic fabric. The foil-like layer is generally comprised of aluminum or some other electrically conductive metal. The laminated fabric is then used to construct the fabric receptacle, for example, with the foil side of the fabric comprising the interior surface. The foil layer provides an electrically conductive surface exposed to the flowable materials through which static electricity generated during material handling is discharged to an appropriate ground.

While adequately discharging static electric build-up, the foil layer in the laminate is susceptible to abrasion, tearing and separation from the fabric layer through normal use of the receptacle. For example, in filling, transporting and/or emptying of foil laminated fabric receptacles, abrasion between the flowable material and the foil layer tends to cause the foil layer to tear and/or separate from the fabric layer. The cumulative effect of such abrasion quickly reduces the effectiveness of the foil layer as a static electric discharge surface. Furthermore, tearing of the foil often results in a release of foil particles and flakes from the fabric contaminating the contained flowable materials.

To address the problems experienced with foil laminated fabrics, U.S. Pat. No. 4,833,008, issued to Norwin C. Derby discloses a metalized fabric comprised of a plastic woven base fabric laminated to a metalized plastic film. The plastic base fabric is preferably a woven polypropylene fabric, and the plastic film is preferably an extruded polypropylene film. The plastic film is metalized through a vapor deposition process whereby a thin film of electrically conductive material is deposited on one side of the plastic film. The woven plastic fabric and the metalized plastic film are then laminated together through use of a plastic adhesive. Unlike foil laminated fabrics, the thin conductive layer deposited on the plastic film is not subject to tearing or flaking.

SUMMARY OF THE INVENTION

The present invention comprises a flexible, collapsible receptacle for handling flowable materials that utilizes both an anti-static fabric and a metalized fabric for receptacle construction to more efficiently and effectively dissipate static electric build-up generated during the handling of flowable materials. Anti-static lift straps are also provided to enhance the static dissipation characteristics of the complete receptacle. The receptacle may have any of those designs known in the art and as taught by U.S. Pat. No. 4,457,456 issued to Norwin C. Derby, et al. the disclosure of which is incorporated herein by reference.

In accordance with a first embodiment of the invention, the fabric utilized for construction of the receptacle parts is a laminated metalized, anti-static fabric. The base fabric for the laminated metalized, anti-static fabric is a woven plastic fabric formed from polypropylene, polyethylene or other suitable plastic made partially conductive to assist in static discharge by impregnating an anti-static agent in the plastic resin used to form the plastic fabric. The base fabric is then laminated, with an anti-static adhesive according the method disclosed in U.S. Pat. No. 4,833,008, to an anti-static resin impregnated plastic film that has been metalized through a vapor deposition process. Adhesion of the plastic film to the fabric forms the laminated metalized, anti-static fabric. This fabric is used for fabricating either the entire collapsible receptacle, just the discharge spout or the discharge spout and bottom wall. In the cases where the laminated metalized, anti-static fabric is not used for fabricating the entire receptacle, an anti-static fabric alone is preferably used to complete the manufacture of the receptacle. A conductive plastic throw away liner may also be inserted into the receptacle to further assist in static discharge.

In accordance with the second embodiment of the invention, an anti-static base fabric, made according to an anti-static impregnation method wherein plastic fabric is dipped in an anti-static agent and dried, and a metalized fabric, made according to the process disclosed in U.S. Pat. No. 4,833,008, are sandwiched and stitched or glued together. The sandwiched metalized and anti-static fabric of the second embodiment is used for fabricating the entire collapsible receptacle, just the discharge spout or the discharge spout and bottom wall. In the cases where the sandwiched metalized and anti-static fabric is not used for fabricating the entire receptacle, an anti-static fabric alone is preferably used to complete the manufacture of the receptacle. A conductive or anti-static plastic throw away liner is also inserted into the receptacle to further assist in static discharge.

A conductor, attached to the conductive inner receptacle surface of either embodiment, is grounded to dissipate static electric build-up generated during handling of the receptacle and any flowable materials inserted therein. Lift straps made from conductive anti-static fabric are also provided. The conjunctive use of a metalized fabric and anti-static fabric to form either a laminated metalized, anti-static fabric or a sandwiched metalized and anti-static fabric for use in fabricating collapsible receptacles provides an improved, more effective and efficient receptacle surface for assisting in the discharge of any generated static electric build-up. The use of such a woven fabric additionally provides the strength needed to handle bulk quantities of flowable materials.

In a third embodiment, a conductive plastic throw away liner is inserted within a fabric receptacle to assist in discharging static electric build-up. The liner has a variable diameter such that its top and bottom ends define fill and discharge spouts for the receptacle. The receptacle has bottom, top and side walls to support the liner. Lift straps at the top corners of the receptacle are also provided. To dissipate static build-up, an appropriate ground source is coupled directly to the surface of the conductive liner.

BRIEF DESCRIPTION OF THE DRAWINGS

A more complete understanding of the invention may be had by reference to the following Detailed description when taken in conjunction with the accompanying drawings wherein.

DETAILED DESCRIPTION OF THE DRAWINGS

Figures 1A, 2A:
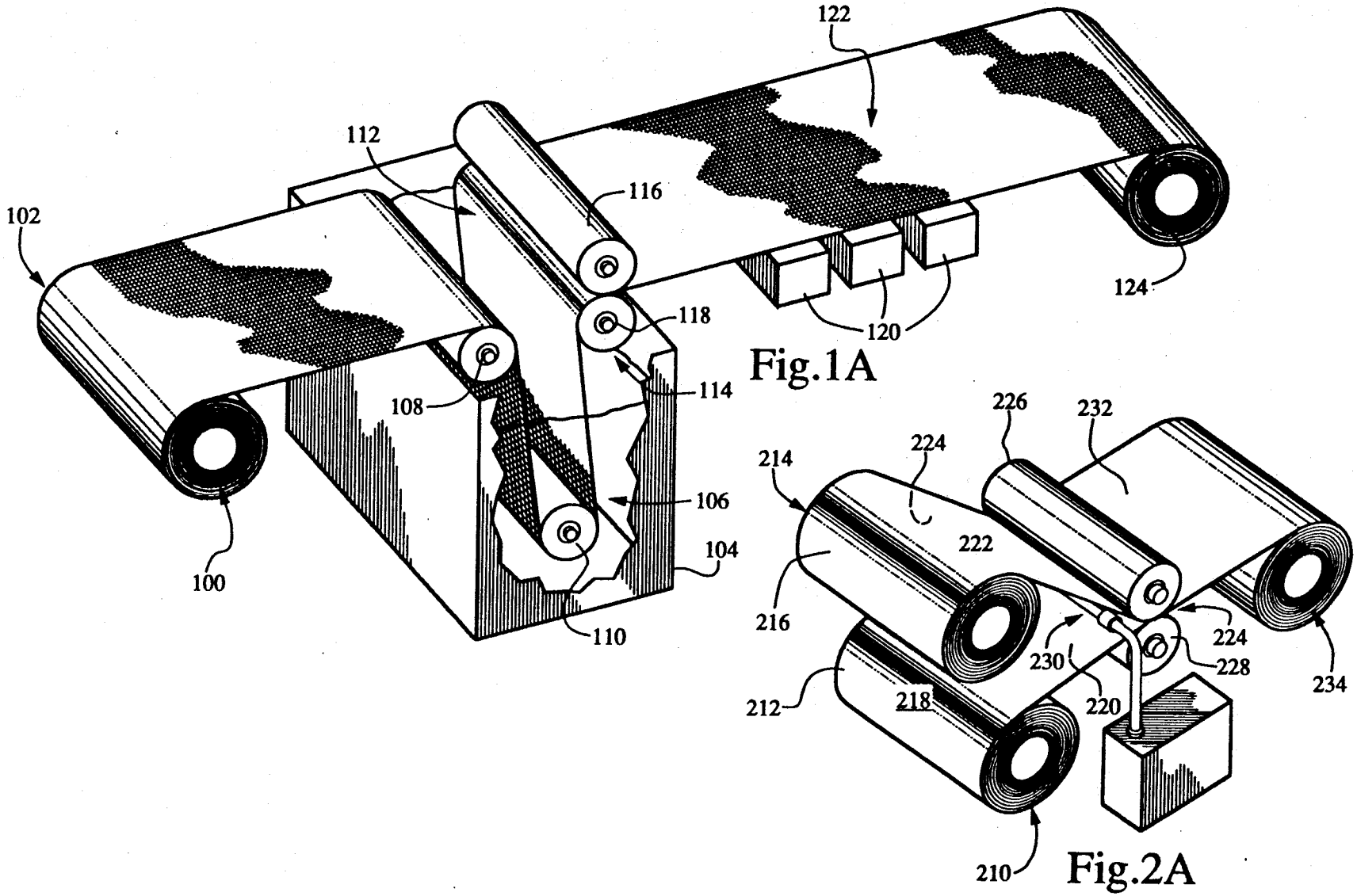
FIG. 1A is a schematic illustration of one method and apparatus for producing anti-static fabric.
FIG. 2A is a schematic illustration of the preferred method and apparatus for laminating a metalized plastic film to a plastic fabric.

Referring now to FIG. 1A, there is shown a schematic illustration of one construction method used for making partially conductive anti-static fabric through application of an anti-static impregnation process. According to the construction method illustrated in FIG. 1A, a roll 100 of plastic fabric 102 is made partially conductive (static dissipating) by soaking the fabric in a vat 104 containing an anti-static liquid 106. It will, of course, be understood that other processes for manufacturing anti-static fabric may be used.

The plastic fabric 102, typically comprised of woven polyethylene or polypropylene, is drawn from roll 100 and directed into the vat 104 by roller 108. The fabric 102 is soaked by the anti-static liquid 106 such that the included anti-static agent in the liquid is impregnated into the fibers of the woven plastic fabric. In the preferred embodiment, a specific anti-static product 106 known under the trade name "ZELEC" ("ZELEC" is a registered trademark of E. I. DuPont de Nemours and Company of Wilmington, Del.) is contained in the vat 104. "ZELEC" is an anti-static agent product designed for use on all types of hydrophobic materials. It will, of course, be understood that any other alternatively suitable anti-static liquid may be substituted for "ZELEC".

Roller 110 assists in maintaining the fabric 102 in the vat 104 such that the fabric is sufficiently soaked by the anti-static liquid 106. The soaked fabric 112 is drawn through a wringer 114 to remove excess anti-static liquid. Wringer 114 is comprised of two compression rollers 116 and 118. The fabric 112 is then dried by means of a number of air driers 120 resulting in a partially conductive, static dissipating fabric 122 impregnated with an anti-static agent as illustrated schematically in cross-section in FIG. 1B. The anti-static fabric 122 is collected on a take-up roll 124.

Figure 1B:
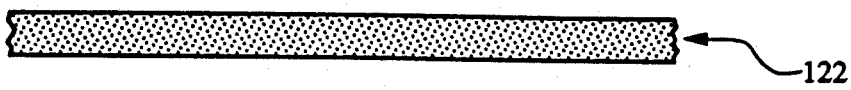
FIG. 1B is a cross-sectional illustration of a piece of anti-static fabric.

A second construction method for making anti-static fabric through anti-static agent impregnation involves inserting an anti-static agent in the plastic resin from which the fibers for the fabric are extruded. A piece of anti-static fabric manufactured according to the resin impregnation method is also shown in FIG. 1B. The resin impregnation method may also be used to manufacture anti-static impregnated plastic film as the anti-static agent can be added to the plastic resin prior to the film extrusion process. Such an impregnated film may be advantageously utilized for fabric and receptacle manufacture as will be described. It will, of course, be understood that other methods for manufacturing an anti-static fabric may be used.

In either the dipped or resin impregnation methods, the holes in the woven anti-static impregnated fabric are sealed by an extrusion coating process whereby the fabric is coated with anti-static resin impregnated plastic. Sealing of the weave holes results in a partially impermeable fabric. Such a sealed fabric is especially useful for containing and handling flowable materials that tend to generate significant amounts of dust. Thus, the materials can be handled more cleanly.

Referring now to FIG. 2A, there is shown a schematic illustration of the method for manufacturing metalized fabric as disclosed in U.S. Pat. No. 4,833,008 issued to Norwin C. Derby. According to the method of the prior art, a roll 210 of plastic fabric 212 is laminated through an adhesion process to a roll 214 of metalized plastic film 216. The plastic fabric 212 is typically comprised of woven polyethylene or polypropylene as previously described, and has an upper surface 218 and a lower surface 220. The plastic film 216 is an extruded polyethylene or polypropylene film having a metalized upper surface 222 and a non-metalized lower surface 224. In manufacturing the metalized fabric according to FIG. 2A, the fabric 212 and film 216 are manufactured from the same type of plastic which either may or may not have been impregnated with an anti-static agent depending on the proposed application of the metalized fabric.

The upper surface 222 of the film 216 is metalized through well known vapor deposition processes to which a thin conductive metallic layer, typically one or two molecules thick, is bonded to the film surface. A number of conductive metals such as aluminum, gold, silver or chromium are available for vapor deposition onto the surface 222 in accordance with the well known processes.

Figure 2B:
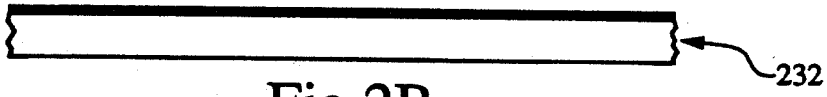
FIG. 2B is a cross-sectional illustration of a piece of laminated metalized fabric constructed according to the method shown in FIG. 2A.

The metalized film 216 is laminated to the plastic fabric 212 by drawing the film 216 and fabric 212 from rolls 214 and 210, respectively, through the nip 224 between two compression rollers 226 and 228. Prior to passage of the film 216 and fabric 212 between the rollers 226 and 228, a thin layer of molten, anti-static impregnated plastic of the same type as the film and fabric, is interposed, as generally indicated at 230, between the lower surface 224 of the film and the upper surface 218 of the fabric. As the film 216 and fabric 212 are compressed between rollers 226 and 228, the molten plastic partially melts and fuses the film and fabric together thereby sealing the holes in the plastic weave. When the molten plastic cools, a secure bond is formed between the film 216 and the fabric 212. The resulting metalized fabric 232, a piece of which is illustrated in cross-section in FIG. 2B, is collected on take-up roll 234.

Figure 3A:
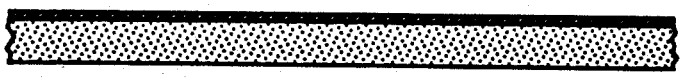
FIG. 3A is a cross-sectional illustration of a piece of laminated metalized, anti-static fabric.

In a first embodiment of the present invention, all or part of a collapsible flexible receptacle is fabricated from a laminated metalized, anti-static fabric. To obtain such a fabric, the manufacturing process illustrated in FIG. 2A and the resin impregnation process described above are utilized. An anti-static fabric and anti-static plastic film are first manufactured according to the resin impregnation process in which the resin used for extruding the fabric and film contains an anti-static agent. The film is then subjected to the metal vapor deposition process. The anti-static fabric is then laminated to the anti-static metalized film according to the process of FIG. 2A. The resulting laminated metalized, anti-static fabric, a piece of which is shown in cross-section in FIG. 3A, is selectively used for fabricating the receptacle. It will of course be understood that the anti-static fabric can alternatively be manufactured according to the process of FIG. 1A, and a non-anti-static film used in the process of FIG. 2A, if preferred.

Figure 3B:
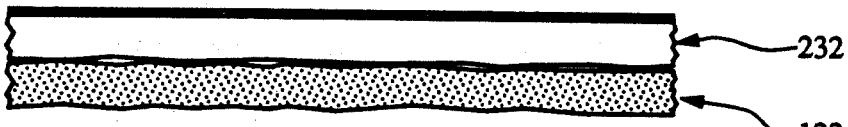
FIG. 3B is a cross-sectional illustration of a piece of sandwiched metalized and anti-static fabric.

In a second embodiment of the present invention, the collapsible flexible receptacle is fabricated from a sandwiched metalized and anti-static fabric. To obtain such a fabric, both manufacturing processes illustrated in FIGS. 1A and 2A and described above are utilized. First, anti-static fabric 122 (FIG. 1B) and metalized fabric 232 (FIG. 2B) are manufactured according to their respective processes. The anti-static fabric and metalized fabric are then sandwiched one over the other and stitched or glued together. The resulting sandwiched metalized and antistatic fabric, a piece of which is shown in cross-section in FIG. 3B, is also selectively used for fabricating the receptacle. It will of course be understood that the resin impregnated anti-static fabric can alternatively be used in the process to manufacture sandwiched fabric as described above, if preferred.

For each receptacle embodiment referred to above using either laminated metalized, anti-static fabric or sandwiched metalized and anti-static fabric (FIGS. 3A and 3B, respectively), three different fabric configurations are available for fabricating the collapsible flexible receptacle, as will be discussed. These fabric configurations may be incorporated into various types of receptacle shapes as are well known in the art. Some of these receptacle shapes are disclosed in U.S. Pat. No. 4,457,456 issued to Norwin C. Derby, et al., and U.S. Pat. Nos. 4,194,652 and 4,143,796 issued to Robert R. Williamson, et al., the disclosures of which are incorporated herein by reference. A side view of an exemplary receptacle shape as disclosed in U.S. Pat. No. 4,457,456 is shown in FIG. 4.

Figure 4:
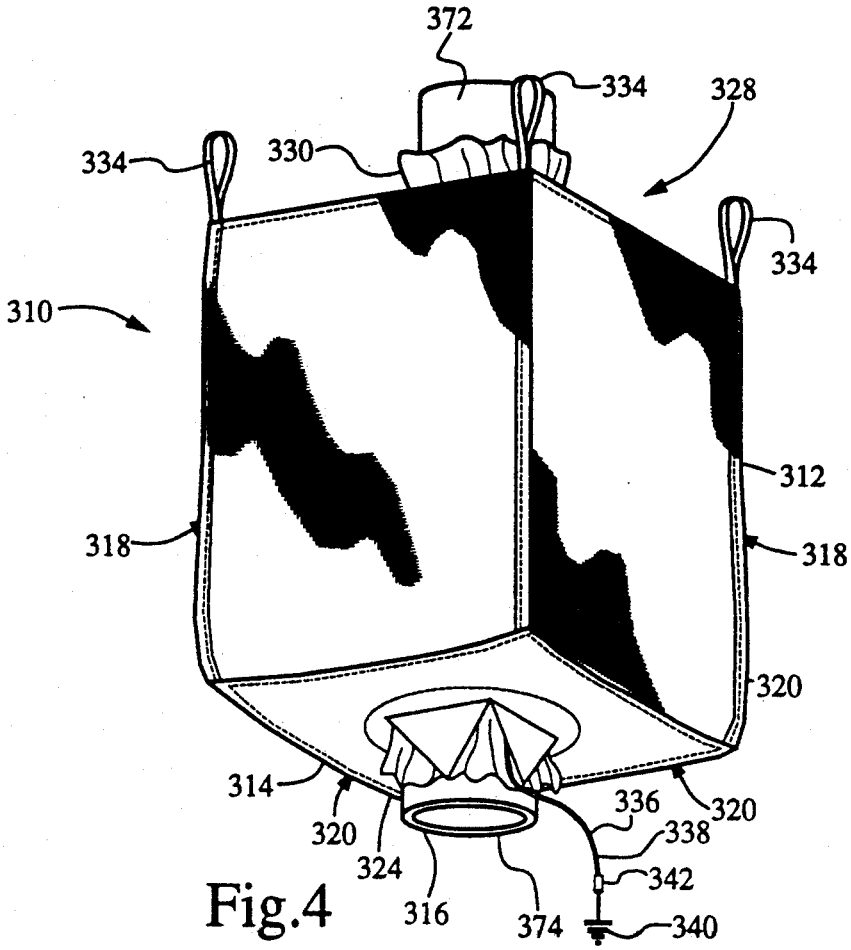
FIG. 4 is an illustration of a flexible, collapsible receptacle fabricated incorporating metalized, anti-static fabric to assist in the dissipation of static-electric build-up.

The receptacle 310 of FIG. 4 is comprised of four side walls 312, a bottom wall 314 and a discharge spout 316. Each side wall 312 comprises a rectangular piece of fabric material. The edges of the rectangular side walls 312 are hemmed, with the hemmed side edges of adjacent side walls secured together by sewing and/or adhesive means as generally indicated at 318 to form a substantially tubular shape. The bottom wall 314 is also a rectangular piece of fabric with its edges hemmed in the same manner as each side wall 312. Each hemmed edge of the bottom wall 314 is secured to a corresponding hemmed lower edge of each side wall 312 by sewing and/or adhesive means as generally indicated at 320. Slits cut in the center of the bottom wall 314 define one or more flaps 322 that open to define a rectangular opening 324. The discharge spout 316 is a rectangular piece of fabric rolled in a tubular configuration with the overlapping hemmed edges secured together with sewing and/or adhesive means. The tubular discharge spout 316 is positioned extending through the opening 324 and secured to the interior of the receptacle 310 at the bottom wall 314, again with sewing and/or adhesive means, as generally indicated at 326. A top wall 328 and an input spout 330 are secured to the hemmed upper edge of each side wall 312 by means of sewing and/or adhesion at 332 to complete fabrication of the receptacle 310.

A support strap 334 is also provided at each of the top corners of the receptacle 310 Each strap 334 is secured to the joined side edges of the side walls 312 as generally indicated at 318. The straps 334 utilized in the preferred embodiment of the present invention are comprised of a webbed anti-static material. Such a material may be obtained from Smith & Nephew Textiles, Ltd. in widths (for example, 55 mm) suitable for use in making straps for collapsible receptacles. Use of such an anti-static fabric for the lift straps assists in the discharge of static electric build-up within the receptacle as will be described.

A conductive lead 336 is stitched at 326 between the bottom wall 314 and the discharge spout 316. An alligator-type connector 338, coupled to a source of ground 340 through a ground lead 342, forms an electrical connection between the inner surface of the receptacle and the ground source. By grounding the receptacle 310, any static-electric charge generated during handling of the receptacle is dissipated. It is well known that static charges in excess of 200,000 Volts may be generated through normal handling of flowable materials in flexible, collapsible receptacles similar to that shown in FIG. 4. Maintaining the ground connection also assists in dissipating any future static-electric build-up that may be generated during further receptacle handling. It will of course be understood that various other techniques may be employed to ground the receptacle for discharge of static electric build-up.

Collapsible receptacles may be constructed of any strong, flexible and substantially inextensible fabric material. Natural or synthetic woven material such as jute, cotton, polyethylene or polypropylene are examples of suitable fabric materials. Woven polypropylene is the preferred material and is chosen as such because of its strength, durability and puncture resistance. The resin from which the plastic (polypropylene) fabric is formed also advantageously accepts anti-static agents to provide an impregnated plastic that is partially conductive and capable of discharging static electric build-up.

In U.S. Pat. No. 4,878,600 issued to Norwin C. Derby, the discharge spout 316 is disclosed as having a conductive inner surface attached to the woven plastic fabric and electrically connected to the conductive lead 336 to assist in discharging and dissipating static charge within the receptacle. The metalized woven plastic fabric described in U.S. Pat. No. 4,833,008 has performed satisfactorily as a discharge surface, but improved discharge capabilities for receptacles and fabrics is needed.

In a first embodiment for the receptacle of the present invention, a laminated metalized, anti-static woven polypropylene fabric as described above (FIG. 3A) is used to fabricate the receptacle according to any one of three fabric configurations. In a second embodiment, a sandwiched metalized and anti-static woven polypropylene fabric as described above (FIG. 3B) is used to fabricate the receptacle according to any one of three fabric configurations. These fabric types provide enhanced discharge performance over the prior art metalized fabric disclosed in U.S. Pat. No. 4,833,008.

It will of course be understood that a receptacle may additionally be fabricated according to the present invention from a mixture of laminated metalized, anti-static and sandwiched metalized and anti-static fabrics if the application so necessitates. For example, laminated fabric may be utilized for the discharge spout while sandwiched fabric is used for constructing the rest of the receptacle. Other fabric configuration utilizing the fabric construction teachings herein are also available, including: 1) a metalized plastic film laminated to a standard plastic fabric with an anti-static adhesive and 2) an anti-static metalized plastic film laminated to a standard plastic fabric with an anti-static adhesive. Conductive fibers may also be woven into the plastic fabric.

Figure 5A:
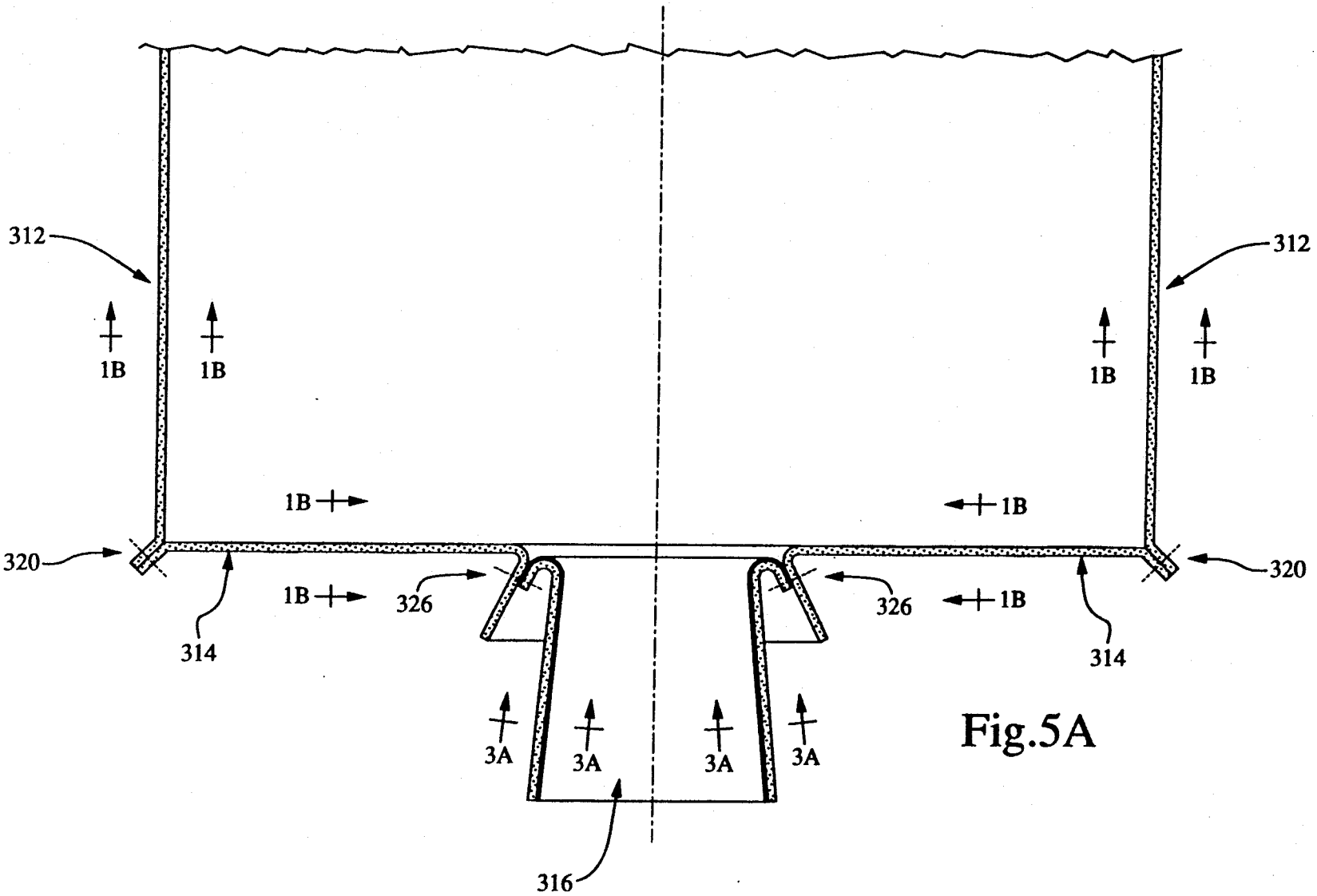
FIGS. 5A to 5C are cross-sectional illustrations of three fabric configurations for a first embodiment of the lower portion receptacle of FIG. 4 incorporating a laminated metalized, anti-static fabric (FIG. 3A)
Figure 5B:
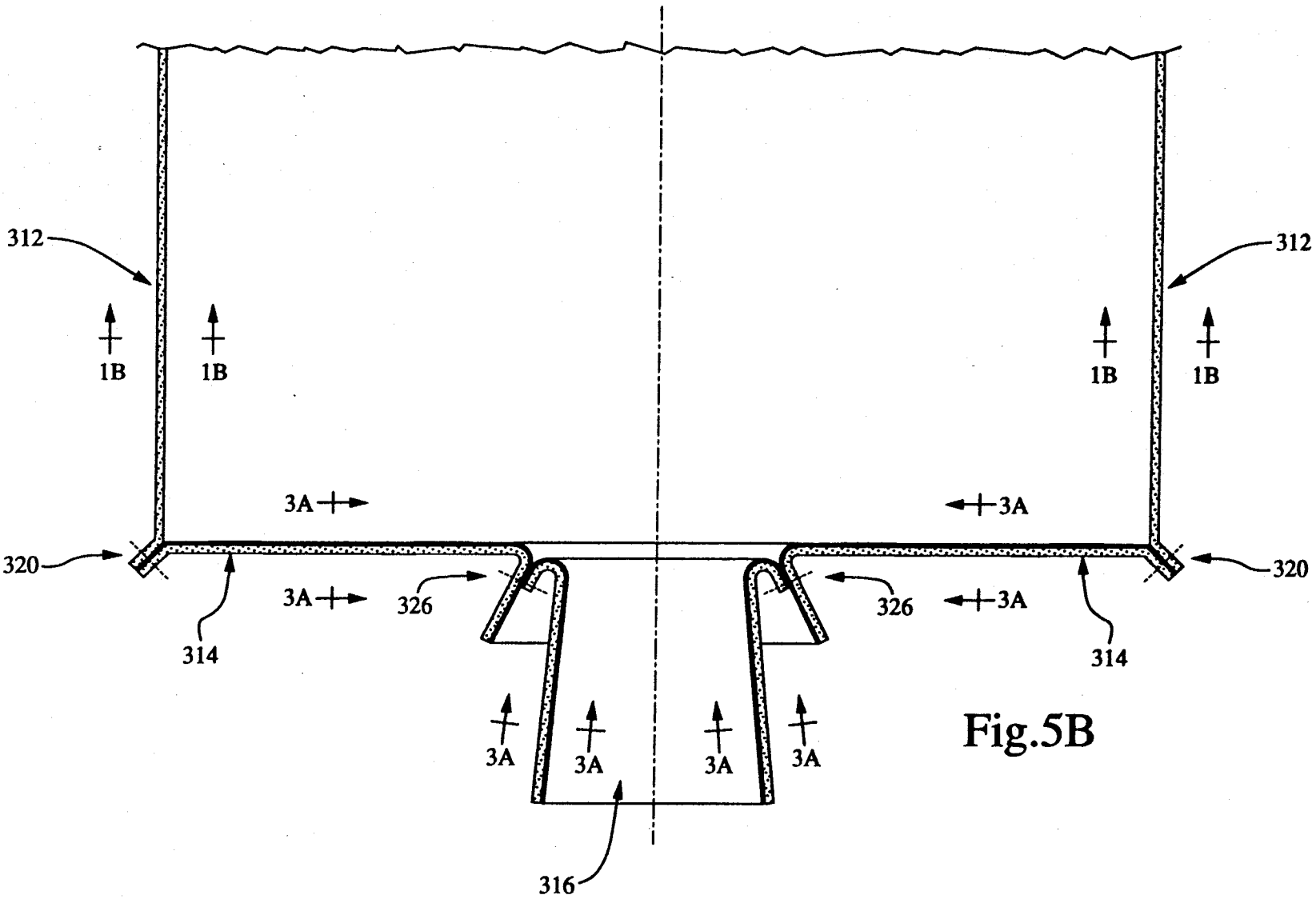
Figure 5C:
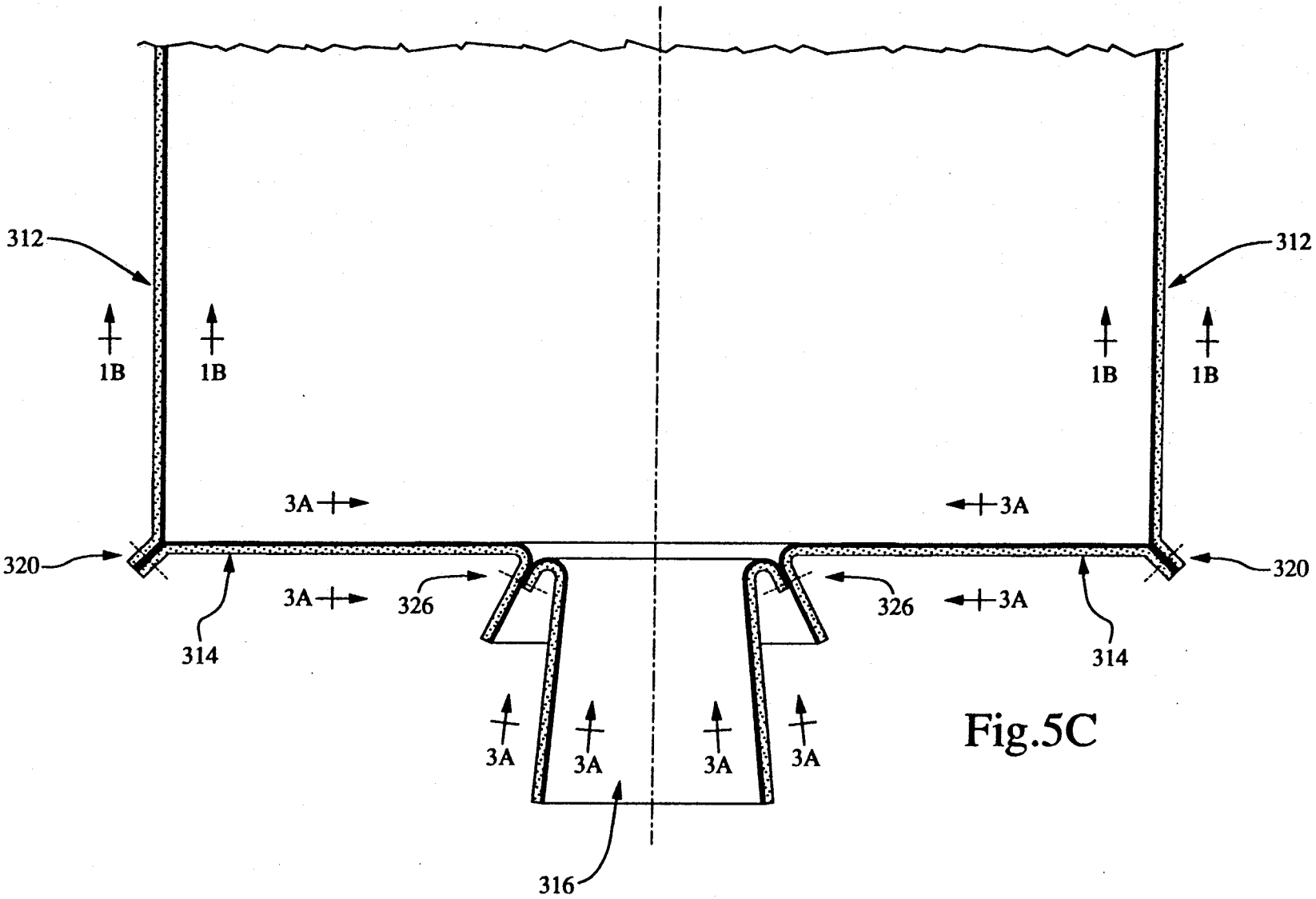
Figure 6A:
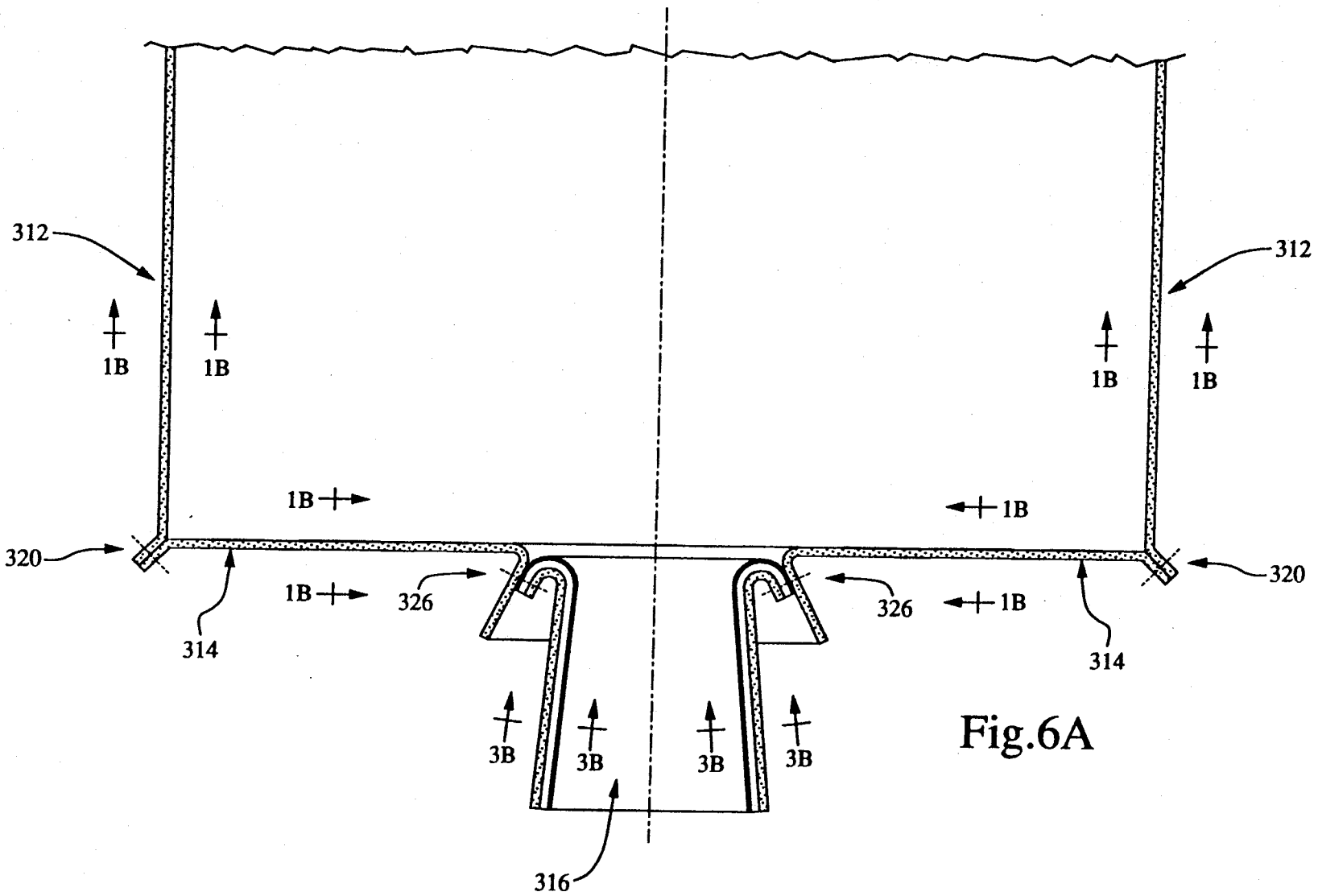
FIG. 6A to 6C are cross-sectional illustrations of three fabric configurations for a second embodiment of the lower portion receptacle of FIG. 4 incorporating a sandwiched metalized and anti-static fabric (FIG. 3B)
Figure 6B:
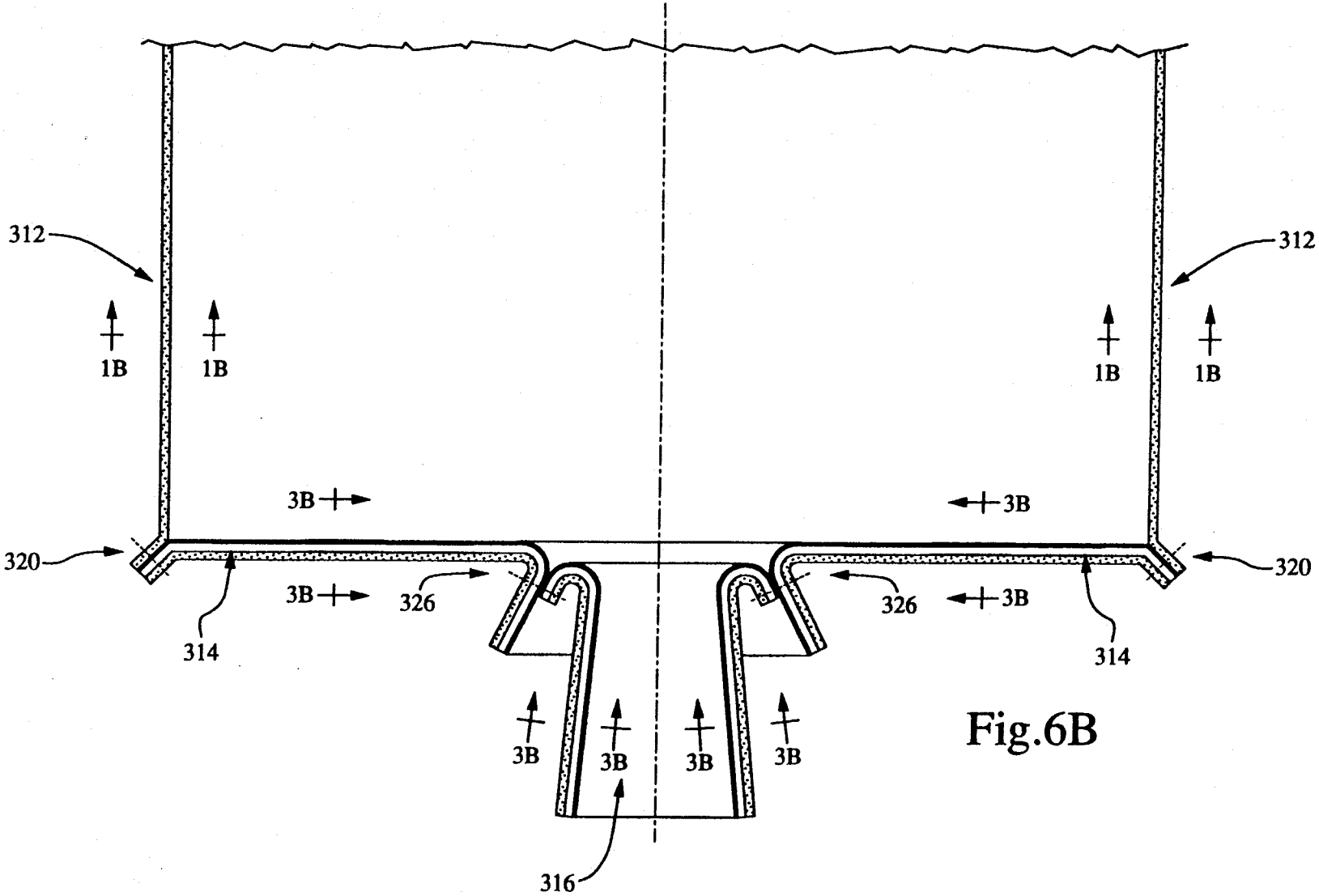
Figure 6C:
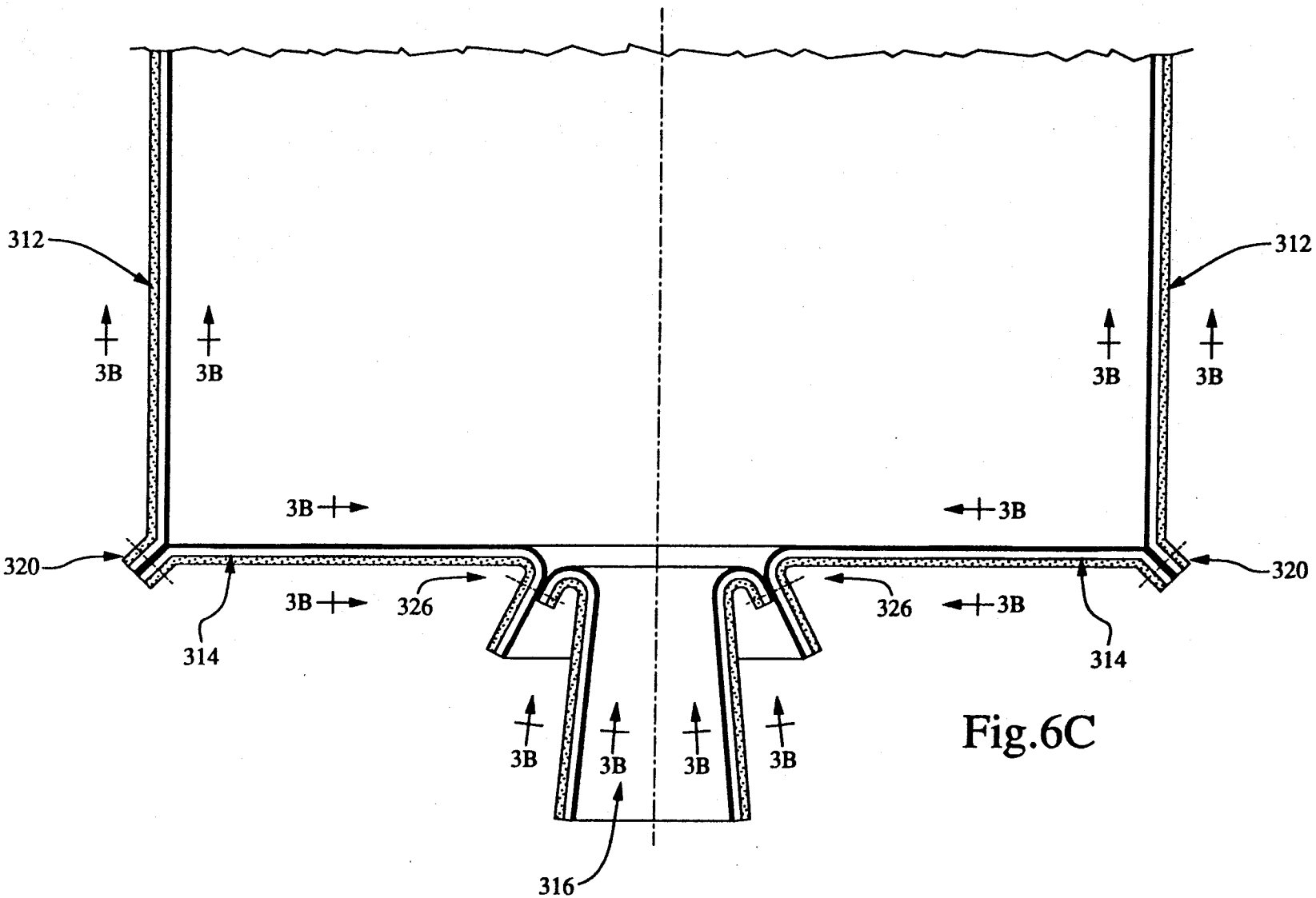

Reference is now made to FIGS. 5A to 5C and FIGS. 6A to 6C to illustrate the three different fabric configurations in each of the two embodiments of flexible collapsible receptacle fabricated according to the present invention. FIGS. 5A to 5C show the bottom portion of the receptacle of FIG. 4 fabricated according to the first embodiment using a laminated metalized, anti-static fabric (FIG. 3A) in each of three fabric configurations. FIGS. 6A to 6C show the bottom portion of the receptacle of FIG. 4 fabricated according to the second embodiment using a sandwiched metalized and anti-static fabric (FIG. 3B) in each of three different fabric configurations.

Reference is now made in particular to FIGS. 5A to 5C for a description of each of the three fabric embodiments utilized in fabrication of a collapsible receptacle using laminated metalized, anti-static fabric. In a first fabric configuration, illustrated in FIG. 5A, the discharge spout 316 of the receptacle shown in FIG. 4 is manufactured from a rectangular piece of laminated metalized, anti-static fabric (FIG. 3A). The four rectangular side walls 312, bottom wall 314 and remainder of the receptacle (not shown), however, are manufactured from pieces of anti-static fabric (FIG. 1B). In a second configuration, illustrated in FIG. 5B, both the bottom wall 314 and discharge spout 316 are manufactured from laminated metalized, anti-static fabric (FIG. 3A) while the four side walls 312 and remainder of the receptacle (not shown) are manufactured from anti-static fabric (FIG. 1B). In a third configuration, illustrated in FIG. 5C, the entire receptacle is manufactured from laminated metalized anti-static fabric (FIG. 3A).

In each configuration illustrated in FIGS. 5A to 5C, the receptacle is fabricated with the metalized side of the laminated metalized, anti-static fabric on the inside of the receptacle to more efficiently discharge static electric build-up. Furthermore, the edges of the fabric pieces used for construction of the receptacle are hemmed and stitched and/or adhesively secured together (as shown generally at 320 and 326) such that their metalized sides will be in conductive contact after completion of the receptacle construction. If the conductive anti-static webbed lift straps described above are employed in fabricating the receptacle, the surface of the lift straps 334 (FIG. 4) should be secured to the hemmed edges of the side walls 312 as generally indicated at 318 such that the metalized fabric surface is in electrical connection with the conductive anti-static lift strap fabric.

FIGS. 6A to 6C show the three types of fabric configurations, described above with respect to FIGS. 5A to 5C, implemented with a stitched, sandwiched metalized and anti-static fabric. For example, FIG. 6A shows the sandwiched metalized and anti-static fabric (FIG. 3B) used for manufacturing the discharge spout 316 while anti-static fabric (FIG. 1B) is used for the side walls 312, bottom wall 314 and the rest of the receptacle (not shown). The second fabric configuration shown in FIG. 6B shows only the bottom wall 314 and discharge spout 316 manufactured from the sandwiched metalized and anti-static fabric (FIG. 3B). In the third fabric configuration, shown in FIG. 6C, the entire receptacle is manufactured from the sandwiched metalized and anti-static fabric (FIG. 3B).

As with the receptacle formed from the laminated fabric, the metalized side of the stitched fabric is disposed on the inside of the receptacle with the fabric edges hemmed and the receptacle constructed such that each piece of the receptacle will be in conductive contact after fabrication (as generally shown at 320 and 326). Placement of the metalized surfaces in conductive contact is necessary to most efficiently dissipate static electric build-up. Such a configuration should also be maintained if mixed laminated and sandwiched metalized, anti-static fabric are used. Furthermore, the conductive anti-static fabric lift straps should preferably be mounted and electrically connected to the metalized portions of the receptacle.

Figure 7:
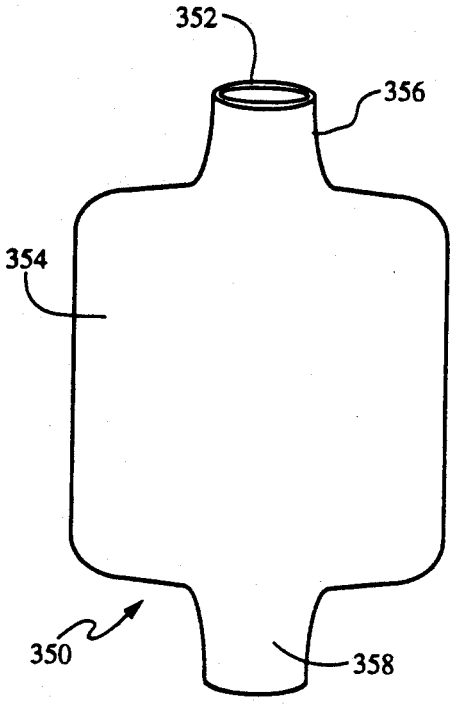
FIG. 7 is a perspective view of a hollow, variable diameter conductive plastic throw away liner.

Referring now to FIG. 7, there is shown a variable diameter, hollow extruded plastic liner 350 manufactured according to the method disclosed in copending U.S. application for patent Ser. No. 07/607,251, filed Oct. 31, 1990, the disclosure of which is incorporated herein by reference. The liner 350 is comprised of an integral, unitary, flexible wall 352 defining a substantially tubular, partially enclosed body section 354 that narrows in diameter toward openings at a first end 356 and a second end 358. In manufacturing the liner 350, anti-static, conductive and semiconductive agents, particles and/or materials (for example, "ZELEC" or carbon black) are introduced into the plastic resin prior to extrusion to make the resulting liner conductive to static electricity. The conductive liner 350 is then coupled at any location to an appropriate source of ground to discharge any static electric build-up within the liner.

The conductive, hollow, variable diameter liner 350 is within the receptacle 310 shown in FIG. 4 incorporating either a laminated metalized, anti-static fabric (FIG. 3A) or a sandwiched metalized and anti-static fabric (FIG. 3B). Conductive contact between the conductive liner 350 and interior metalized surface of the receptacle 310 enables static charge within the liner and receptacle to be discharged through the conductive lead 336 to the ground source 340. However, when either laminated metalized, anti-static fabric (FIG. 3A) or sandwiched metalized and anti-static fabric (FIG. 3B) are used to fabricate the entire receptacle 310 (see FIGS. 5C and 6C), the use of a conductive liner is not necessary as the completely metalized interior surface satisfactorily performs to discharge static build-up.

Figure 8:
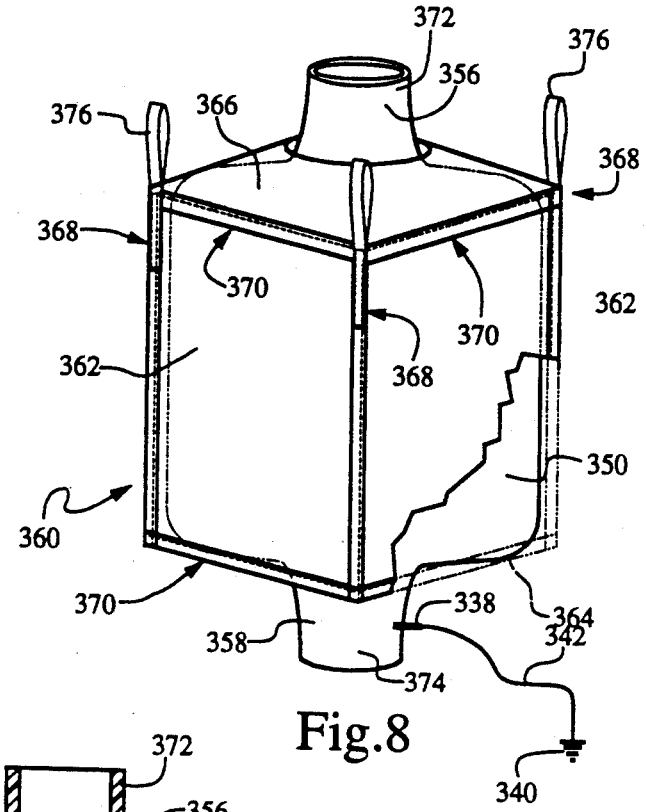
FIG. 8 is a broken perspective view of a third embodiment for a static discharge fabric receptacle incorporating a conductive plastic liner as in FIG. 7.
Figure 9:
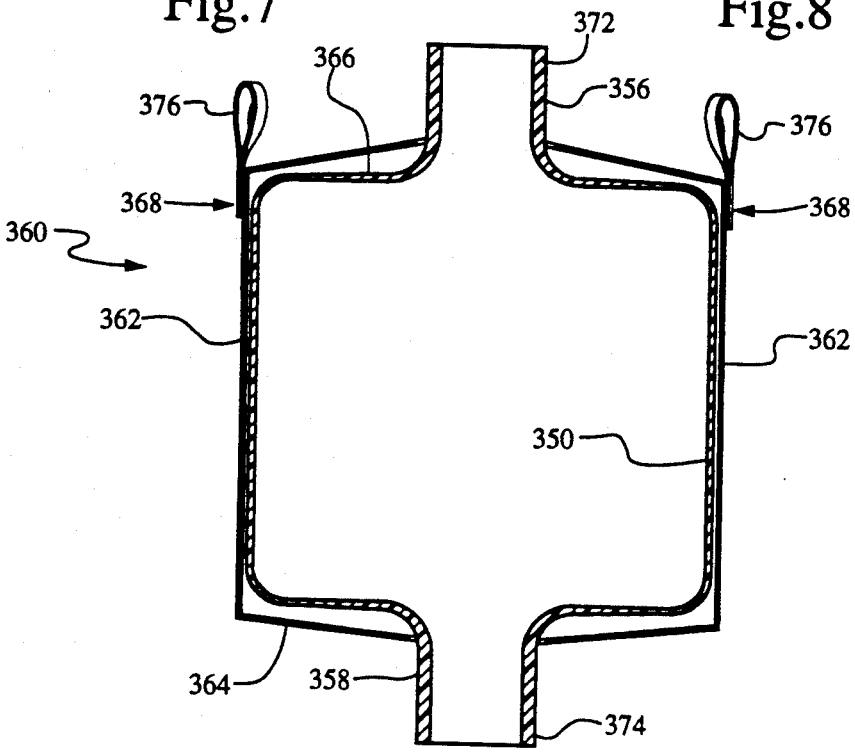
FIG. 9 is a cross sectional view of the fabric receptacle of FIG. 8.

Referring now to FIGS. 8 and 9, there is shown, in broken perspective and cross section views, respectively, a collapsible flexible fabric receptacle 360 incorporating a conductive, hollow, variable diameter plastic liner 350. The fabric material used to fabricate the receptacle is typically a woven polypropylene, but may also be an anti-static impregnated or metalized fabric. The receptacle 360 is comprised of four side walls 362, a bottom wall 364 and a top wall 366. A support strap 376 is also provided at each of the top corners of the receptacle 360. Each strap 376 is secured to the joined side edges of the side walls 362 as generally indicated at 368.

The side walls 362 are comprised of rectangular pieces of plastic fabric material. The edges of the rectangular side walls 362 are hemmed, with the hemmed side edges of adjacent side walls secured together by sewing and/or adhesive means as generally indicated at 368 to form a substantially tubular shape. The bottom wall 364 and top wall 366 are also rectangular pieces of plastic fabric with their edges hemmed in the same manner as each side wall 362. Each hemmed edge of the bottom wall 364 and top wall 366 is secured to a corresponding hemmed lower and upper edge of each side wall 362 by sewing and/or adhesive means as generally indicated at 370.

A substantially circular opening cut in the center of both the bottom wall 364 and top wall 366 allows for the insertion, within the receptacle 360, of a conductive, hollow, variable diameter plastic liner 350 (FIG. 7). Once inserted within the receptacle 360, the narrowed diameter of and openings in the liner 350 at the first and second ends, 356 and 358, respectively, define a fill spout 372 and discharge spout 374, respectively, for the receptacle 360. With the use of a liner 350, there is no need to include an additional discharge and fill spout attached to the bottom and top walls, 364 and 366, respectively, although one may be included as indicated at 316 and 330 in FIG. 4.

An alligator-type connector 338, clipped to the liner 350 and coupled to a source of ground 340 through a ground lead 342, forms an electrical grounding connection between the inner surface of the liner and receptacle 360 and the ground source. By grounding the liner 350 and receptacle 360, any static-electric charge generated during filling, storage, handling and/or discharge of the receptacle is dissipated.

Although preferred embodiments of the receptacle of the present invention have been illustrated in the accompanying drawings and described in the foregoing detailed description, it will be understood that the invention is not limited to the embodiment disclosed, but is capable of numerous rearrangements, modifications and substitutions without departing from the spirit of the invention as set forth and defined by the following claims.

We claim:

1. A collapsible product receptacle, comprising:

a substantially tubular fabric side wall having a fabric bottom wall secured to the tubular side wall around a lower end thereof for closing the lower end of the receptacle, the bottom wall having an opening therein;

a cylindrical fabric discharge spout extending through the opening in, and secured to the bottom wall;

a plurality of conductive lift straps secured to the receptacle;

an electrically conductive layer inside the receptacle; and means for electrically connecting the electrically conductive layer and the conductive lift straps to a source of predetermined electrical potential to dissipate build-up of static-electric charge within the receptacle.

2. The collapsible product receptacle as in claim 1, wherein the electrically conductive layer comprises an integral, unitary and flexible tubular shaped conductive liner inserted within the receptacle.

3. The collapsible product receptacle as in claim 1 wherein the electrically conducive layer comprises a conductive plastic film layer laminated of the fabric comprising the receptacle.

4. A collapsible product receptacle, comprising:

a substantially tubular fabric side wall having an inner surface;

a fabric bottom wall secured to the tubular side wall around a lower end thereof for enclosing the lower end of the receptacle, the bottom wall having an opening therein and an upper surface facing inside the receptacle;

a cylindrical fabric discharge spout secured to the bottom wall and extending through the opening therein, the discharge spout having an inner surface;

an electrically conductive layer on the spindle of the receptacle laminated to the discharge spout inner surface with an anti-static adhesive layer; and means for electrically connecting the electrically conductive layer to a source of predetermined electrical potential to dissipate static-electric charge within the receptacle.

5. The collapsible product receptacle as in comand 4 wherein the electrically conductive layer comprises a thin layer of conductive metal vapor deposited on a plastic film layer.

6. The collapsible product receptacle as in claim 4 further including electrically conductive fibers woven into the fabric of the receptacle to assist in static-electric discharge.

* * * * *

UNITED STATES PATENT AND TRADEMARK OFFICE

CERTIFICATE OF CORRECTION

PATENT NO. : 5,244,281

DATED : September 14, 1993

INVENTOR(S) : Robert R. Williamson
Norwin C. Derby

It is certified that error appears in the above-identified patent and that said Letters Patent is hereby corrected as shown below:

Column 3, line 52, "static-electric" should be --static electric--.
Column 3, line 58, "FIG." should be --FIGS--
Column 3, line 67, "cross sectional" should be --cross-sectional--.
Column 5, line 13, "well known" should be --well-known--.
Column 5, line 18, "well known" should be --well-known--.
Column 5, line 66, "antistatic" should be --anti-static--.
Column 6, line 11, "well known" should be --well-known--.
Column 6, line 47, "310 Each" should be --310. Each--.
Column 6, line 64, "static-electric" should be --static electric--.
Column 6, line 65, "well known" should be --well-known--.
Column 7, line 2, "static-electric" should be --static electric--.
Column 9, line 28 "cross section" should be --cross-section--.
Column 10, line 2, "static-electric" should be --static electric--.
Column 10, line 7, "drawings" should be --Drawings--.
Column 10, line 8, "detailed description" should be --Detailed Description--.
Column 10, line 16, "side wall having" should be --side wall;--,
Column 10, line 58, "static-electric" should be --static electric--.
Column 10, line 66, "static-electric" should be --static electric--.
Column 10, line 39, "of" should be --to--.
Column 10, line 53, "spindle" should be --inside--.
Column 10, line 60, "comand" should be --claim--.

Signed and Sealed this

Sixth Day of June, 1995

Bruce Lehman

*Attest:*

BRUCE LEHMAN

*Attesting Officer*

*Commissioner of Patents and Trademarks*